US006102654A

United States Patent [19]

Oeynhausen et al.

[11] Patent Number: 6,102,654

[45] Date of Patent: Aug. 15, 2000

[54] TURBOMACHINE AND METHOD FOR COOLING A TURBOMACHINE

[75] Inventors: Heinrich Oeynhausen, Muelheim A.D. Ruhr; Edwin Gobrecht, Ratingen; Helmut Pollak, Muelheim A.D. Ruhr; Andreas Feldmueller, Bochum, all of Germany

[73] Assignee: Siemens Aktiengesellschaft, Munich, Germany

[21] Appl. No.: 09/217,855

[22] Filed: Dec. 21, 1998

Related U.S. Application Data

[63] Continuation of application No. PCT/DE97/01162, Jun. 9, 1997.

[30] Foreign Application Priority Data

Jun. 21, 1996 [DE] Germany ..... 196 24 805

[51] Int. Cl.[7] ..... F01D 25/12

[52] U.S. Cl. ..... 415/115; 415/99; 415/100; 415/101; 415/103; 415/110; 415/113; 415/208.1; 416/198 A

[58] Field of Search ..... 415/99, 100, 101, 415/103, 110, 113, 115, 116, 208.1; 416/198 A

[56] References Cited

U.S. PATENT DOCUMENTS

| | | | |
|---|---|---|---|
| 2,826,895 | 3/1958 | English . | |
| 4,242,041 | 12/1980 | Silvestri, Jr. | 415/115 |
| 4,312,624 | 1/1982 | Steinbauer et al. . | |
| 4,386,885 | 6/1983 | Beckershoff | 415/178 |
| 4,571,153 | 2/1986 | Keller | 415/117 |
| 4,648,791 | 3/1987 | Kreitmeier | 415/116 |
| 5,292,227 | 3/1994 | Czachor et al. . | |

FOREIGN PATENT DOCUMENTS

| | | |
|---|---|---|
| 0 088 944 B1 | 10/1985 | European Pat. Off. . |
| 0 315 486 A2 | 5/1989 | European Pat. Off. . |
| 0 542 403 A1 | 5/1993 | European Pat. Off. . |
| 32 09 506 A1 | 9/1983 | Germany . |
| 34 06 071 A1 | 8/1984 | Germany . |
| 430 757 | 8/1967 | Switzerland . |

OTHER PUBLICATIONS

Japanese Patent Abstract No. 57188702 (Michinobu et al.), dated Nov. 19, 1982.

Japanese Patent Abstract No. 58155203 (Eijirou), dated Sep. 14, 1983.

Japanese Patent Abstract No. 59155503 (Tadashi), dated Sep. 4, 1984.

Dietmar Bergmann et al.: "Dampflurbinen für fortgeschrittene Kraftwerkkonzepte mit hohen Dampfzuständen", Siemens Power Journal Jan. 1993, pp. 5–10, steam turbines for advanced power–station concepts with high steam conditions.

*Primary Examiner*—F. Daniel Lopez
*Assistant Examiner*—Matthew T. Shanley
*Attorney, Agent, or Firm*—Herbert L. Lerner; Laurence A. Greenberg; Werner H. Stemer

[57] ABSTRACT

A turbomachine, especially a steam turbine, includes a casing, an inflow region formed at least in part by the casing for guiding working fluid, a feed for a cooling fluid, a rotating-blade carrier disposed in the casing and extending along a principal axis, and a shielding element disposed in the inflow region for shielding the rotating-blade carrier from the working fluid. The shielding element is attached to the casing by a mounting and the feed is guided through the mounting. A method is also provided for cooling one or more components of a turbomachine adjoining an inflow region for a hot working gas.

17 Claims, 1 Drawing Sheet

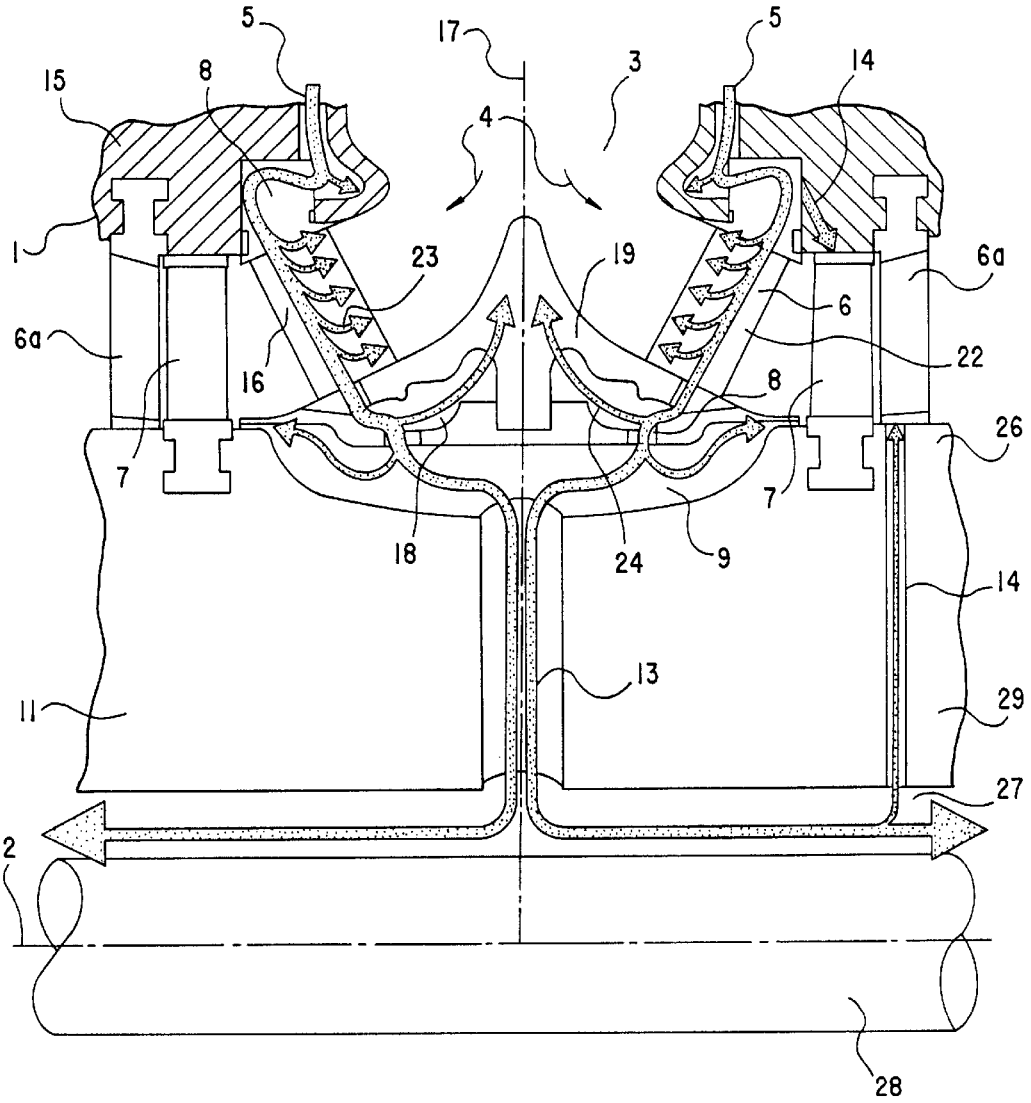
5
17
5
15
8
3
14
4
1
23
19
6a
6
6a
22
16
8
26
7
7
18
24
9
14
13
11
29
27
2
28

TURBOMACHINE AND METHOD FOR COOLING A TURBOMACHINE

CROSS REFERENCE TO RELATED APPLICATION

This application is a continuation of International Application No. PCT/DE97/01162, filed Jun. 9, 1997, which designated the United States.

BACKGROUND OF THE INVENTION

Field of the Invention

The invention relates to a turbomachine, especially a steam turbine, having a casing and an inflow region for working fluid which is formed at least in part by the casing. The invention also relates to a method for cooling at least one component associated with an inflow region of a turbomachine.

The use of steam at relatively high pressures and temperatures, especially at so-called supercritical steam conditions with a temperature of, for example, above 550° C., contributes to an increase in efficiency of a steam turbine. The use of steam in such a steam condition makes increased demands on a steam turbine supplied with the steam, especially on steam-turbine components adjoining the inflow region for the working fluid, such as a wall of the casing and a turbine shaft.

An article entitled "Dampfturbinen fur fortgeschrittene Kraftwerkskonzepte mit hohen Dampfzustanden" [Steam turbines for Advanced Power-Station Concepts with High Steam Conditions] by D. Bergmann, A. Drosdziok and H. Oeynhausen, in Siemens Power Journal 1/93, pp. 5–10 describes a rotor shield configuration with swirl cooling. With swirl cooling, steam flows into a region between the rotor shield configuration and a rotor in the direction of rotation of the turbine shaft through four tangential holes in the rotor shield configuration. In the process, the steam expands, the temperature falls and the rotor is thereby cooled. The rotor shield configuration is connected in a steam-tight manner to a fixed-blade row. Through the use of the swirl cooling, it is possible to achieve a reduction in the temperature of the rotor in the region of the rotor shield configuration of about 15 K. A more detailed explanation of that rotor shield configuration, which surrounds the turbine shaft with a clearance and is connected to radially inner ends of the fixed blades of the first fixed-blade ring, is given in European Patent 0 088 944 B1. Nozzles are fitted in the rotor shield configuration and, as viewed in the direction of rotation of the shaft, they open tangentially into an annular passage formed between the shaft and the shaft shield configuration. A further example of a rotor shield configuration can be taken from German Published, Non-Prosecuted Patent Application DE 32 09 506 A1.

Swiss Patent No. 430 757 describes a shielding element in the inflow region of a steam turbine. That shielding element is connected with a feed which is located centrally in the inflow region, i.e. in the hot working steam flow. That feed acts as a mounting for the shielding element.

German Published, Non-Prosecuted Patent Application DE 34 06 071 A1 describes a double-flow steam turbine, which has a shielding element for the turbine shaft in an inflow region for hot steam. That shielding element is connected with the housing through the first rows of rotating-blades. A gap is formed between the shielding element and the turbine shaft. The shielding element has an opening in its center for the hot steam, so that the hot steam flowing in the gap feeds back into the main stream of hot steam before the first row of rotating-blades.

SUMMARY OF THE INVENTION

It is accordingly an object of the invention to provide a turbomachine and a method for cooling a turbomachine, which overcome the hereinafore-mentioned disadvantages of the heretofore-known devices and methods of this general type, in which the turbomachine can be cooled in a region subject to high thermal loading, especially an inflow region for working fluid and in which the method cools at least one turbomachine component adjoining the inflow region.

With the foregoing and other objects in view there is provided, in accordance with the invention, a turbomachine, especially steam turbine, comprising a casing; an inflow region for a working fluid, the inflow region formed at least in part by the casing; a rotating-blade carrier disposed in the casing and extending along a principal axis; a shielding element disposed in the inflow region for shielding the rotating-blade carrier from the working fluid; a mounting constructed as a first fixed blade, the mounting attaching the shielding element to the casing; and a feed guided through the mounting for feeding a cooling fluid.

The mounting is preferably integrated into at least one fixed-blade row which is first as seen in the direction of the working fluid.

In accordance with another feature of the invention, the feed is guided in the casing at least partially in the vicinity of the inflow region, for cooling the inflow region. The feed, which is provided in the casing, enables cooling of the casing, especially of casing walls adjoining the inflow region. Constructing a casing with such a feed for cooling fluid makes it possible to significantly lower the temperature of the casing even when working fluid is flowing into the inflow region at temperatures of above 550° C., and this makes it possible to use known materials, especially martensitic chromium steels, or to use new materials at a reduced temperature level. The cooling fluid can be process steam from a steam turbine installation with a plurality of turbines sections, separate cooling steam or cooling air.

The shielding element can be connected to the casing at a number of points by a respective mounting or a plurality of mountings. A number of cooling effects are achieved simultaneously, namely cooling of the casing at the walls adjoining the inflow region, cooling of the mounting, cooling of the shielding element and therefore also cooling of the rotating-blade carrier. Effective cooling of a plurality of components of the turbomachine is achieved with a single flow of cooling fluid by using a feed made up of a plurality of sections and passed through the flow path of the working fluid.

In accordance with a further feature of the invention, in order to increase the cooling of the first fixed-blade row, i.e. the mounting, a branch conduit, preferably a plurality of branch conduits, is provided, which are connected to the feed and open into the inflow region and/or a side remote from the inflow region. Additional film cooling of the first fixed-blade row is thereby achieved.

In accordance with an added feature of the invention, the shielding element likewise has at least one branch conduit, which is connected to the feed and opens into the inflow region. This leads to film cooling of the shielding element and therefore indirectly to a further reduction in the temperature loading of the rotating-blade carrier. The shielding element can additionally have a cavity connected to the feed, thereby avoiding increased heat transfer in the shielding element in the direction of the rotating-blade carrier.

In accordance with an additional feature of the invention, through the use of the shielding element, which is, in particular, of annular construction, an interspace into which the feed opens is formed in the direction of the rotating-blade carrier. The interspace can thus be filled with cooling fluid, reducing heat transfer from the shielding element heated by the working fluid to the rotating-blade carrier.

Since the shielding element is connected to the casing through the mounting, it is spaced apart from the rotating-blade carrier, thus ensuring that the cooling fluid flows away with the working fluid flowing between the casing and the rotating-blade carrier.

In accordance with yet another feature of the invention, there is provided a cooling-fluid conduit, especially one constructed as a radial hole, leading from the interspace into the rotating-blade carrier. This leads to further cooling.

In accordance with yet a further feature of the invention, there is provided a rotating-blade carrier formed by two or more rotor discs which are disposed centrally to one another and are connected through the use of a tie passed through corresponding openings. In this configuration, cooling fluid is introduced into an annular space formed between the tie and the rotor disc. Cooling of an essentially one-piece turbine shaft is, of course, also possible, particularly by providing at least one axial hole which extends parallel to the principal axis and into which the cooling-fluid conduit opens.

In addition to cooling of the components of the turbomachine which are subject to high temperature loading, feeding cooling fluid through the casing also permits a reduction in a leakage flow of working fluid through a gap between a rotating component (rotating blade, rotating-blade carrier) and a fixed component (fixed blade, casing) of the steam turbine. These so-called gap losses can be reduced by diverting cooling fluid from the feed, the interspace or the cooling-fluid conduit through corresponding branch conduits in the casing and the rotating-blade carrier and can be passed into this gap. A branch conduit of this kind is thus preferably passed from the feed for cooling fluid in such a way that it opens into a gap between the casing and the rotating blade or the fixed blade and the rotating-blade carrier. The sealing ability of a contactless seal between a rotating and a fixed component of the turbomachine is thus significantly increased.

In accordance with yet an added feature of the invention, guidance of cooling fluid is suitable particularly for a turbomachine in which the shielding element is constructed to divide the flow and/or deflect the working fluid in the direction of the principal axis. The inflow region is preferably constructed to guide the working fluid in a direction essentially perpendicular to the principal axis of the rotating-blade carrier.

With the objects of the invention in view, there is also provided a turbomachine, especially a steam turbine, comprising an inflow region for a working fluid; a casing at least partially forming the inflow region, the casing having a surface and a given region near the surface bordering on the inflow region; and a feed disposed in the casing for feeding a cooling fluid to cool the casing in the given region.

In accordance with another feature of the invention, the casing has a region opposite the rotating blade, and at least one barrier-fluid conduit is connected to the feed and emerges in the region of the casing opposite the rotating blade.

In accordance with a further feature of the invention, the rotating-blade carrier has a rotating-blade carrier region opposite the fixed blade, and at least one barrier-fluid conduit is connected to the feed and emerges in the rotating-blade carrier region.

In accordance with an added feature of the invention, the turbo-machine is a double-flow steam turbine, especially a medium-pressure steam turbine, in which both flow division and deflection of the working fluid take place. Such cooling is, of course, also possible for a single-flow steam turbine, in its inflow region. If process steam from a steam-turbine installation is used as the cooling fluid, this steam is fed back to the overall steam process through the various branches, with the steam used as the cooling fluid being heated up as it flows through the feed. It is thereby possible to achieve an increase in the efficiency of the steam turbine as compared with cooling where the process steam is lost.

With the objects of the invention in view, there is also provided a method for cooling at least one component of a turbomachine, especially a steam turbine, having a casing, a shielding element, a rotating-blade carrier disposed in the casing, and an inflow region adjoining the at least one component and formed at least in part by the casing, which comprises feeding cooling fluid, in particular cooling air or process steam, through the casing, in particular in the vicinity of the inflow region, to the shielding element to reduce temperature loading on the rotating-blade carrier.

Other features which are considered as characteristic for the invention are set forth in the appended claims.

Although the invention is illustrated and described herein as embodied in a turbomachine and a method for cooling a turbomachine, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawing.

BRIEF DESCRIPTION OF THE DRAWINGS

The FIGURE of the drawing is a fragmentary, diagrammatic, not to scale, longitudinal-sectional view through a double-flow medium-pressure steam turbine.

DESCRIPTION OF THE PREFERRED EMBODIMENT

Referring now in detail to the single FIGURE of the drawing, there is seen a portion of a turbomachine 1 illustrated in a longitudinal section through a double-flow medium-pressure steam turbine of a steam-turbine installation. A rotating-blade carrier 11 extending along a principal axis 2 is shown in a casing 15 of the turbomachine. This carrier is manufactured from a plurality of rotor discs 29, only one of which is illustrated for the sake of clarity. A tie 28 which joins the rotor discs together to form the rotating-blade carrier 11 is passed centrally through the rotor disc 29, along the principal axis 2. The rotating-blade carrier 11 can, of course, also be manufactured as a one-piece turbine shaft. The casing 15 forms an inflow region 3 for working fluid 4, which extends essentially along an inflow axis 17, perpendicular to the principal axis 2.

A cooling-fluid feed 8, which is likewise essentially parallel to the inflow axis 17, is provided by the casing 15 in the vicinity of the inflow region 3. This feed 8 enters a respective fixed blade 6 in a first fixed-blade row 16. Branch conduits 23 which branch off in the fixed blade 6 or in a plurality of fixed blades open into the inflow region 3. The first fixed-blade row 16 furthermore serves as a mounting 22 for an annular shielding element 19. This shielding element 19 arches into the inflow region 3 and thus both deflects the working fluid 4 and shields the rotating-blade carrier 11 (turbine rotor) from this working fluid 4. The feed 8 leads from the fixed blade 6 into the shielding element 19. The shielding element 19 has a cavity 18, which is connected to the feed 8, extends essentially parallel to the principal axis 2 and is in part widened in the direction of the inflow region 3. Branch conduits 24 which branch off from the cavity 18 open into the inflow region 3. Corresponding film cooling of the shielding element 19 is thereby achieved, as with the branch conduits 23 of the fixed blades 6. The feed 8 opens from the shielding element 19 into an interspace 9 formed between the shielding element 19 and the rotating-blade carrier 11.

Cooling fluid 5 entering the interspace 9 flows at least partially in axial direction out of the interspace 9 into the flow of working fluid 4 and thus passes through turbine stages formed by rotating blades 7 and downstream fixed blades 6a. A cooling-fluid conduit 13, which is constructed as an axial hole, leads from the interspace 9 into the rotating-blade carrier 11 and there opens into an annular gap 27 formed between the tie 28 and the rotor disc 29.

The cooling fluid 5 flowing into the annular gap 27 removes heat from the rotating-blade carrier 11. In addition, a barrier-fluid conduit 14 is disposed in the rotor disc 29 or one or more downstream rotor discs. The barrier-fluid conduit 14 opens from the annular gap 27 into a rotating-blade carrier region 26 which lies directly opposite a fixed blade 6*a*. This ensures a flow of cooling fluid 5 into a gap formed between the rotating-blade carrier region 26 and the fixed blade 6*a*. There, the cooling fluid 5 additionally has the action of a barrier fluid, through the use of which a flow of the working fluid 4 through this gap is prevented or at least significantly reduced. It is thereby possible, in addition, to reduce gap losses in the case of a contactless seal and thus also increase the efficiency of the steam turbine.

Further barrier-fluid conduits 14', through which cooling fluid 5 can flow, are provided in the casing 15 and connect the feed 8, in the region of the first fixed-blade row 16, to a region 25 of the casing which lies directly opposite a rotating blade 7. In addition to cooling, this provides sealing of this gap by the cooling fluid 5, which then additionally acts as a barrier fluid.

The invention is distinguished by cooling, preferably of a plurality of components of a turbomachine, which adjoin an inflow region for a hot working fluid, especially steam at above 550° C. The cooling is accomplished by introducing a cooling fluid, especially process steam from a steam turbine installation or cooling air, through a feed which is disposed in a part of the casing that is close to the surface and faces the inflow region. From there, the cooling air is passed through the first fixed-blade row into a shielding element which is secured on the fixed-blade row. It is possible to provide branch conduits in the casing, the fixed blade and the shielding element. The branch conduits open into the inflow region and thus permit film cooling of the respective component. Furthermore, it is possible, through the use of barrier-fluid conduits branching off from the feed, to additionally pass cooling fluid as barrier fluid into a gap between a rotating component (rotating blade, rotating-blade carrier) and a fixed component (fixed blade, casing), thereby significantly improving the sealing of a contactless seal.

We claim:

1. A turbomachine, comprising:

a casing;

an inflow region for a working fluid, said inflow region formed at least in part by said casing;

a rotating-blade carrier disposed in said casing and extending along a principal axis;

a shielding element disposed in said inflow region for shielding said rotating-blade carrier from the working fluid;

a mounting constructed as a fixed blade, said mounting attaching said shielding element to said casing; and a feed conduit guided through said mounting for feeding a cooling fluid into said shielding element.

2. The turbomachine according to claim 1, wherein said feed is guided in said casing at least partially in the vicinity of said inflow region, for cooling said inflow region.

3. The turbomachine according to claim 1, wherein said mounting has at least one branch conduit connected to said feed and opening into said inflow region.

4. The turbomachine according to claim 1, including at least one branch conduit in said shielding element, said branch conduit connected to said feed and opening into said inflow region.

5. The turbomachine according to claim 1, wherein said shielding element and said rotating-blade carrier define an interspace therebetween, and said feed opens into said interspace.

6. The turbomachine according to claim 5, including a cooling-fluid conduit leading from said interspace into said rotating-blade carrier.

7. The turbomachine according to claim 6, wherein said rotating-blade carrier has at least two rotor discs, a tie connects said rotor discs to one another, said tie and said rotor discs define an annular space therebetween, and said cooling-fluid conduit opens into said annular space.

8. The turbomachine according to claim 1, wherein said shielding element divides a flow of said working fluid and deflects said working fluid along said principal axis.

9. The turbomachine according to claim 1, wherein said shielding element divides a flow of said working fluid.

10. The turbomachine according to claim 1, wherein said shielding element deflects said working fluid along said principal axis.

11. The turbomachine according to claim 1, including a rotating blade, said casing having a region opposite said rotating blade, and at least one barrier-fluid conduit connected to said feed and emerging in said region of said casing opposite said rotating blade.

12. The turbomachine according to claim 1, wherein said rotating-blade carrier has a rotating-blade carrier region opposite said fixed blade, and at least one barrier-fluid conduit is connected to said feed and emerges in said rotating-blade carrier region.

13. A double-flow medium-pressure steam turbine, comprising:

a casing;

an inflow region for a working fluid, said inflow region formed at least in part by said casing;

a rotating-blade carrier disposed in said casing and extending along a principal axis;

a shielding element disposed in said inflow region for shielding said rotating-blade carrier from the working fluid;

a mounting constructed as a fixed blade, said mounting attaching said shielding element to said casing; and a feed conduit guided through said mounting for feeding a cooling fluid into said shielding element.

14. In a method for cooling at least one component of a turbomachine having a casing, a shielding element, a rotating-blade carrier disposed in the casing, and an inflow region adjoining the at least one component and formed at least in part by the casing, the improvement which comprises:

feeding cooling fluid through the casing to the shielding element to reduce temperature loading on the rotating-blade carrier.

15. The method according to claim 14, which comprises feeding the cooling fluid in the vicinity of the inflow region.

16. The method according to claim 14, which comprises feeding cooling air as the cooling fluid.

17. The method according to claim 14, which comprises feeding process steam as the cooling fluid.

* * * * *